US006135194A

United States Patent [19]

Flinn et al.

[11] Patent Number: 6,135,194

[45] **Date of Patent: *Oct. 24, 2000**

[54] SPRAY CASTING OF METALLIC PREFORMS

[75] Inventors: John E. Flinn, Idaho Falls; Joseph V. Burch, Shelley, both of Id.; James W. Sears, Niskayuna, N.Y.

[73] Assignee: Bechtel BWXT Idaho, LLC, Idaho Falls, Id.

[ * ] Notice: This patent issued on a continued prosecution application filed under 37 CFR 1.53(d), and is subject to the twenty year patent term provisions of 35 U.S.C. 154(a)(2).

[21] Appl. No.: 08/638,254

[22] Filed: Apr. 26, 1996

[51] Int. Cl.[7] ..... B22D 11/06; B22D 23/00

[52] U.S. Cl. ..... 164/46; 164/479

[58] Field of Search ..... 164/46, 271, 429, 164/479; 427/349, 422, 425; 118/302

[56] References Cited

U.S. PATENT DOCUMENTS

| | | | |
|---|---|---|---|
| Re. 31,767 | 12/1984 | Brooks | 29/527.2 |
| 3,909,921 | 10/1975 | Brooks | 29/527.2 |
| 4,515,864 | 5/1985 | Singer | 428/546 |
| 4,779,802 | 10/1988 | Coombs | 239/292 |
| 4,787,935 | 11/1988 | Eylon et al. . | |
| 4,804,034 | 2/1989 | Leatham et al. | 164/46 |
| 4,905,899 | 3/1990 | Coombs et al. | 239/11 |
| 4,926,923 | 5/1990 | Brooks et al. | 164/5 |
| 4,926,924 | 5/1990 | Brooks et al. | 164/5 |
| 4,938,275 | 7/1990 | Leatham et al. | 164/46 |
| 5,110,631 | 5/1992 | Leatham et al. | 427/422 |
| 5,131,451 | 7/1992 | Ashok et al. | 164/46 |
| 5,143,139 | 9/1992 | Leatham et al. | 164/46 |
| 5,143,140 | 9/1992 | Melillo et al. | 164/46 |
| 5,196,049 | 3/1993 | Coombs et al. | 75/338 |
| 5,240,061 | 8/1993 | Watson et al. | 164/46 |
| 5,366,204 | 11/1994 | Gigliotti, Jr. et al. | 266/202 |
| 5,460,851 | 10/1995 | Jenkins | 427/422 X |

FOREIGN PATENT DOCUMENTS

| | | | |
|---|---|---|---|
| 61-202752 | 9/1986 | Japan | 164/46 |
| 63-84760 | 4/1988 | Japan | 164/46 |
| 4-41063 | 2/1992 | Japan | 164/46 |
| 4-258363 | 9/1992 | Japan | 164/46 |
| 4-258364 | 9/1992 | Japan | 164/46 |
| 5-161956 | 6/1993 | Japan | 164/46 |
| 6-623 | 1/1994 | Japan | 164/46 |

OTHER PUBLICATIONS

Jenkins, W.N., et al, "Melt Heat Extraction in the Sprayforming of Strip: The SDL Experimental Strip Unit," a publication of Sprayforming Developments Ltd., Swansea, Wales, Fall 1990.

Eadie, G.C., "The Continuous Production of Steel and Alloy Strip Using Sprayforming," a British Steel publication, Sep. 13–15, 1993.

(List continued on next page.)

*Primary Examiner*—J. Reed Batten, Jr.
*Attorney, Agent, or Firm*—Armstrong Westerman Hattori McLeland & Naughton

[57] ABSTRACT

A metal alloy is melted in a crucible and ejected from the bottom of the crucible as a descending stream of molten metal. The descending stream is impacted with a plurality of primary inert gas jets surrounding the molten metal stream to produce a plume of atomized molten metal droplets. An inert gas is blown onto a lower portion of the plume with a plurality of auxiliary inert gas jets to deflect the plume into a more restricted pattern of high droplet density, thereby substantially eliminating unwanted overspray and resulting wasted material. The plume is projected onto a moving substrate to form a monolithic metallic product having generally parallel sides.

6 Claims, 2 Drawing Sheets

OTHER PUBLICATIONS

Annavarape, S., et al, "Evolution of Microstructure in Spray Casting," *The Internatioanl Journal of Powder Metallurgy,* vol. 29, No. 4 (1993), pp. 331–343.

Payne, R.D., et al, "Application of Neural Networks in Sprayforming Technology," *The International Journal of Powder Metallurgy,* vol. 29, No. 4 (1993) pp. 345–351.

Leatham, A.G., et al., "The Osprey Process: Principles and Applications," *The International Journal of Powder Metallurgy,* vol. 29, No. 4 (1993), pp. 321–329.

Tsao, C.A., et al., "Modelling of the Liquid Dynamic Compaction Spray Process," *The International Journal of Powder Metallurgy,* vol. 30, No. 3 (1994), pp. 323–333.

SPRAY CASTING OF METALLIC PREFORMS

CONTRACT AND ORIGIN OF THE INVENTION

The United States Government has rights in this invention pursuant to Contract No. DE-AC07-94ID13223 between Lockheed Idaho Technologies Company and The United States Department of Energy.

BACKGROUND OF THE INVENTION

1. Field of the Invention

This invention relates to methods and apparatus for the spray casting of metallic preforms and, more particularly, to methods and means to shape a stream of gas-atomized metal particles deposited on a heated substrate thereby providing a monolithic product with minimized or no wastage due to thin metal deposits near the edges of the particle stream.

2. State of the Art

Sprayforming involves the feeding of molten metal through a nozzle into an enclosed chamber filled with inert gas. After exiting the nozzle, the molten metal stream is atomized by inert gas jets into a fine spray or plume of molten droplets which are projected onto a collecting surface. In the simplest cases, the collector is a flat disc that rotates to produce an even deposit. To make a solid cylinder, the collector plate is withdrawn by a hydraulic ram at the same rate as the top surface layer is being built up. To make metal matrix composites (MMCs), refractory, e.g. silicon carbide, powder is added during the atomization process to mix with the powder in the metal droplet stream.

A process for metal spraying, or metallizing, in which droplets of hot metallic materials are projected onto a base material to form a coating, was developed in Switzerland about 1910 by Dr. M. U. Schoop. Such metallizing differs from spray forming in that, in the former process, deposition rates are an order of magnitude less, and is used mainly for coatings. In the 1940s and 1950s, an early proponent of spray forming, Brennan, suggested various techniques for producing metal strips. In the 1960s, Professor Singer developed the so-called "Spray Rolling Process," a system to produce metal sheet by inert gas atomization and deposition of the thus-produced metal particles onto a rotating drum. Sprayforming Developments Ltd. (SDL), located at the Innovation Centre, University College, Swansea, Wales, is a company formed to exploit the developments of Singer and his co-workers and holds many patents, including those covering the basic sprayforming process, centrifugal spray deposition, simultaneous shot-peening, pneumatic scannning atomizer, multi-phase metals, coatings, and spray control; see, for example, Singer U.S. Pat. Nos. 4,224,356 and 4,515,864. See also Jenkins et al. "Melt Heat Extraction in the Sprayforming of Strip: The SDL Experimental Strip Unit."

The Osprey™ process was developed in the early 1970s, and involved preprogrammed control of a substrate motion to accept deposition of semi-solid metal droplets. A key point in this process is that the substrate surface also must remain semi-solid during the deposition process. Therefore, instead of a particulate microstructure (characteristic of thermal spraying techniques) a fine, uniform, equiaxed grain structure, with no interconnected porosity, is formed. Of particular significance is the ability of the Osprey™ process to operate at high deposition rates producing large billets with uniform microstructures or equivalent or superior properties to conventionally-produced materials. Osprey Metals Limited, Neath, Wales, also holds many patents; see, for example: Brooks U.S. Pat. No. 3,909,921; Coombs U.S. Pat. No. 4,779,802; Leatham et al. U.S. Pat. No. 4,804,034; Coombs et al. U.S. Pat. No. 4,905,899; Leatham et al. U.S. Pat. No. 4,938,275; Brooks et al. U.S. Pat. No. 4,926,924; Brooks et al. U.S. Pat. No. 4,926,923; Leatham et al. U.S. Pat. No. 5,110,631; Leatham et al. U.S. Pat. No. 5,143,139; Coombs et al. U.S. Pat. No. 5,196,049; Watson et al. U.S. Pat. No. 5,240,061, and Brooks Re 31,767; see also Leatham et al. "The Osprey Process: Principles and Applications," *The International Journal of Powder Metallurgy*, Vol. 29, No. 4 (1993) pages 321–329.

In 1980, Sandvik, in Sweden, developed a large-scale spray forming plant for the production of tubes and produces special grades of stainless steels and superalloys in tubular shape up to 8 meters long.

In 1985, Alcan, in Canada, under license from Osprey, installed a small facility producing sprayforms 300 mm diameter and 1 meter long, and patented some new aspects, including: twin head atomizers; a continuous production plant; Al-Li alloys; MMC particulate feeder/preheater; Ultralite alloys, and powder products from overspray.

In 1991, Sumitomo Heavy Industries, in Japan, installed a commercial spray forming facility to produce roll preforms. This facility has the ability to produce 1 ton high-carbon, high-speed steel rolls up to 80 mm in diameter and 500 mm long and having longer service life as compared to conventionally cast rolls, mainly as a result of a finer and more uniform carbide microstructure.

Various articles have been published concerning spray forming by one process or another. See for example: Eadie, "The Continuous Production of Steel and Alloy Strip Using Sprayforming," a British Steel publication; Payne et al., "Application of Neural Networks in Spray Forming Technology," *The International Journal of Powder Metallurgy*, Vol 29, No. 4 (1993), pages 345–351; Annavarapu et al., "Evolution of Microstructure in Spray Casting," *The International Journal of Powder Metallurgy*, Vol. 29, No. 4 (1993) pages 331–343; Tsao et al., "Modelling of the Liquid Dynamic Compaction Spray Process," *The International Journal of Powder Metallurgy*, Vol. 30, No. 3 (1994), pages 323–333.

In the sprayforming process, the atomized metal particles are deposited directly onto a stationary or moving substrate to form a monolithic product. See also Melillo et al. U.S. Pat. No. 5,143,140; Ashok et al. U.S. Pat. No. 5,131,451.

In most of these processes, atomization is carried out by the socalled remotely-coupled technique in which the atomizing gas hits the metal stream some distance away from its exit from the liquid metal reservoir. More recently, a closely-coupled technique has been used in the production of metal powder in which the atomizing gas is directed at the liquid metal stream just as it emerges from the liquid metal nozzle. This latter technique has the advantage of providing greater amounts of strengthening elements in solid solution and/or in the form of finely dispersed precipitates. Gigliotti, Jr. et al. U.S. Pat. No. 5,366,204. It is believed that the closely-coupled technique has not been used in commercial sprayforming.

Secondary jets have been used to cool the descending plume of atomized metal particles. U.S. Pat. No. 5,196,049 (secondary jets are positioned adjacent the primary, atomizing, jets for directing cooling fluid at the atomized droplets); U.S. Pat. No. 4,787,935 (high pressure cooling fluid is directed at the descending metal particle plume through passageways in the wall of a chamber in which the plume is formed).

A shortcoming of prior art sprayforming methods and apparatus is found in the wastage usually incurred in the form of relatively thin overspray layers of metal deposited on the edges of the descending plume of atomized particles projected onto a substrate material. These thin layers are a natural result of the generally Gaussian-shape curve of a cross-section of the generally conically-shaped particle plume, wherein is the particle depositions is more concentrated along the edge of the cone. The build-up is greater in the direction of the substrate motion. The lateral edges of the deposit may not be useful as a product and such wastage may amount to 15% or more of the deposited material.

SUMMARY OF THE INVENTION

The present invention provides a close-coupled atomization step and single-pass deposition of sprayformed product on a heated substrate, and wherein auxiliary heated gas jets are projected, through plume deflectors, against the descending plume of atomized metal particles, thereby confining the plume to a more restricted area and substantially eliminating thinner overspray deposits where the edges of the projected plume normally would impinge on the substrate material. The result is a relatively sharp-edged monolithic deposit having fine, stable grains and which is essentially entirely useful as a final product or a product for subsequent forming, with little or no wastage of deposited metal.

DESCRIPTION OF PREFERRED EMBODIMENTS

Figure 1:
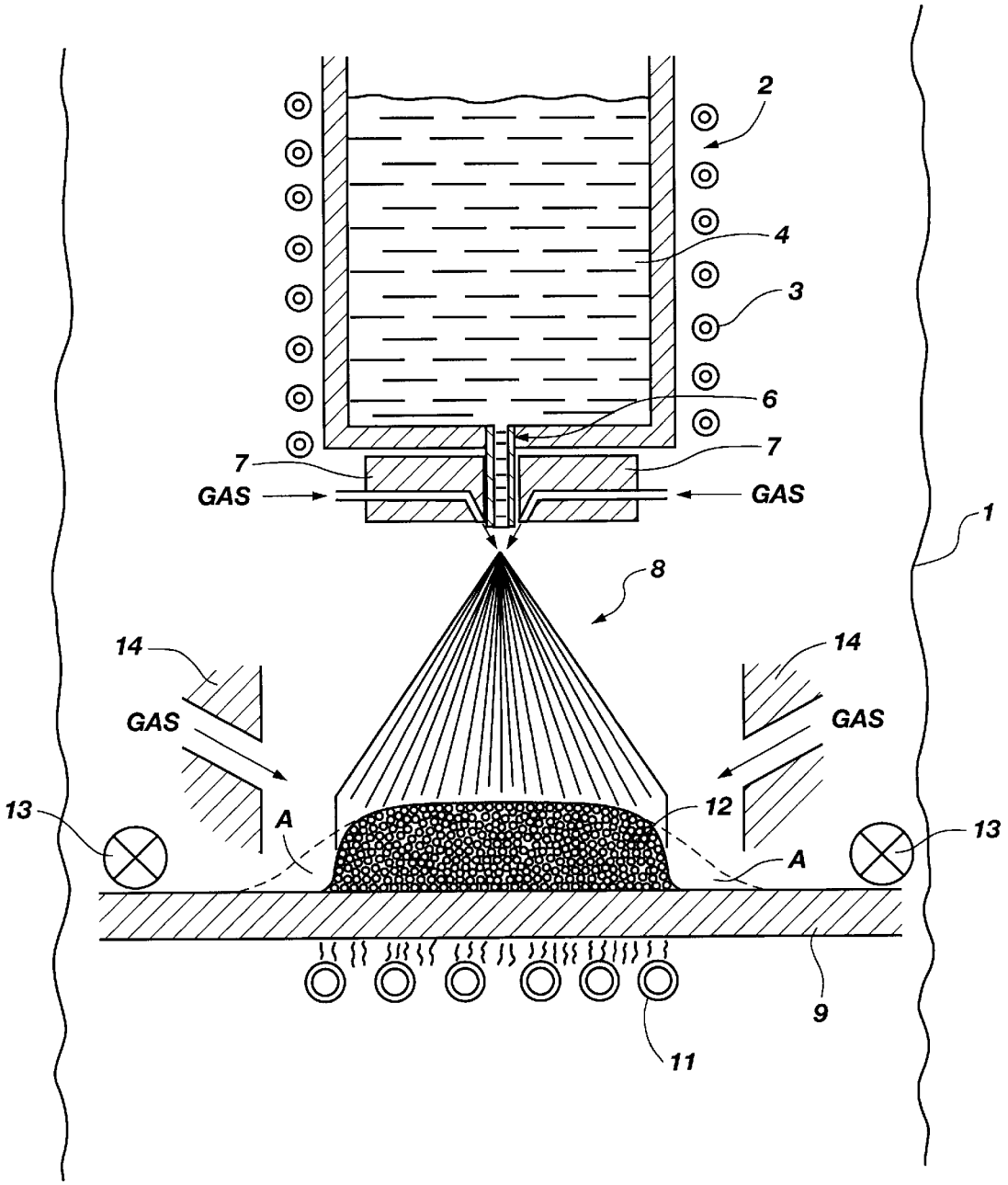
FIG. 1 is a cross-sectional side elevational view of an apparatus of the invention, including auxiliary gas jet plume deflectors to confine the shape of the descending plume of atomized metal particles, and providing a relatively sharp-edged monolithic sprayformed deposit.

The apparatus depicted in FIG. 1 includes an enclosure 1 containing an inert gas atmosphere and within which is disposed a reservoir or crucible 2 for melting a metal, e.g. by means of induction coils 3, and containing a body of liquid metal 4. A guide tube or nozzle 6 is disposed in an opening in the bottom of crucible 2 for directing a stream of molten metal downwardly out of the crucible and inwardly of a plurality of gas atomization nozzles 7 disposed in an annular arrangement about the descending stream of molten metal. As shown in FIG. 1, atomization of the molten metal stream is closely-coupled, that is, the atomizing gas, such as nitrogen, helium or argon, impacts the molten metal stream substantially as the molten metal stream exits the guide tube 6. Such configuration provides a fine spray or plume 8 of molten metal droplets which is directed generally downwardly to impinge upon a solid substrate 9 which is heated, as by electrical coils 11, to produce a monolithic sprayformed product 12. The substrate 9 may be moved, either linearly in a direction generally perpendicular to the vertical centerline of the plume 8, or rotationally, as by means 13, and is heated, e.g. to about 600° C., to improve the microstructure and quality of the deposited product, e.g. in respect to porosity.

As indicated by the dashed lines A in FIG. 1, the projected plume 8 normally produces a Gaussian-like overspray pattern near the edge of the plume, resulting in product "wings" which are thinner than the main body of the deposited product. These "wings" must be removed before further processing of the deposited article takes place and thus are wasted, resulting in an economic loss.

In order to eliminate or reduce such overspray material and, consequently, to increase the technical and economic efficiency of the sprayforming process, the invention provides plume deflectors comprising manifolds 14 through which auxiliary inert gas jets are impinged on the descending plume 8 and confining it to a more concentrated or restricted pattern of high metal droplet density at the area of impact of the plume on the substrate 9.

Figure 2:
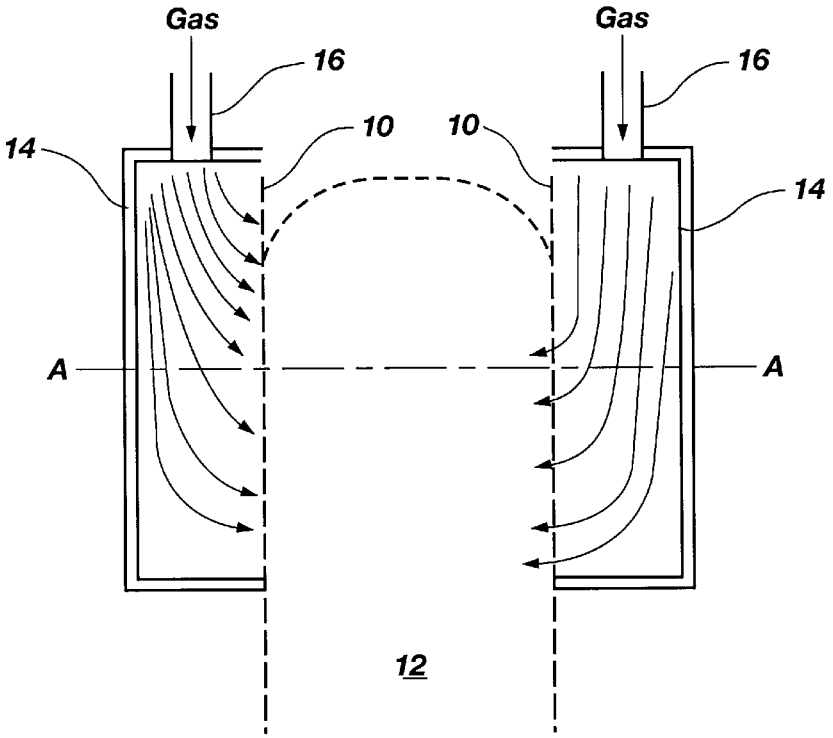
FIG. 2 is a top plan view showing, in more detail, the plume deflectors of the invention and the sprayformed deposit.
Figure 3:
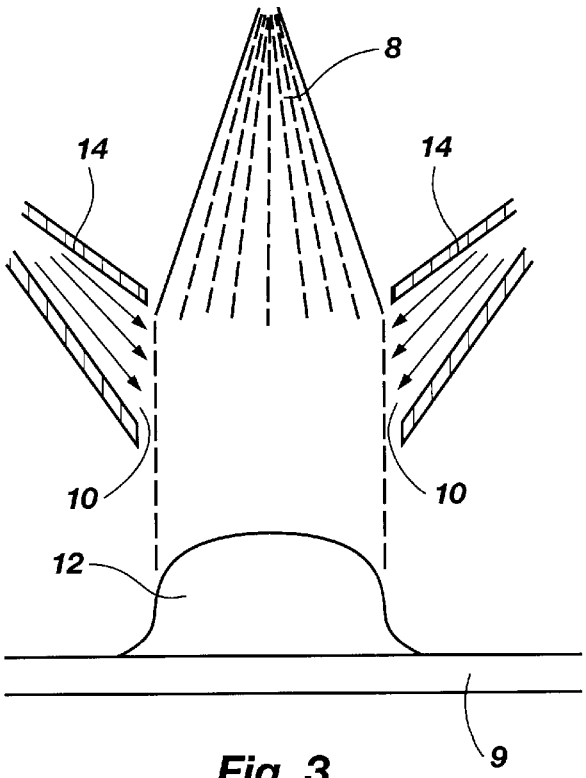
FIG. 3 is an elevational view of the plume deflectors and the sprayformed deposit, taken along line A—A of FIG. 2.

The auxiliary gas deflectors 14 are shown in more detail in FIGS. 2 and 3. In FIG. 2, these deflectors 14 are shown as thin gas manifolds extending parallel to the direction of travel of substrate 9. The manifolds are provided with slots 10 through which the auxiliary gas exits to impinge on plume 8. The slots of the two-piece manifold are angled at about 45° with respect to the horizontal, and the lengths of the deflector manifolds are comparable to the width divergence of the plume 8, which depends upon on the size and melt flow of the atomizer and the distance from the initial melt stream break-up to the substrate. For the laboratory-scale apparatus used in the experiments herein described, a distance of from about 2.5 to 3.5 inches between the guide tube or nozzle 6 and the substrate 9 provided the best results. The deflector manifolds 14 have openings 16 through which a heated gas is passed into the interior of the deflectors and spreads throughout the manifold in a pattern, as shown, to be projected from slots 10 onto the descending plume 8 of metal droplets. The resulting, relative sharp-edged deposit 12 is more clearly shown in FIG. 3. It is desirable that the auxiliary gas be preheated in order not to unduly interfere with the normal cooling of the plume droplets as they descend and are convectively cooled by interaction with the inert gas atmosphere in enclosure 1.

The process and apparatus as described produce ring and bar preforms to satisfy the material property requirements for subsequent processing by wire drawing, ring rolling, and sheet metal forming. Close-coupling gas atomization produces near fully dense deposits of more uniform microstructure and retention of the benefits of rapid solidification; and the use of the plume deflectors produces near final shape deposits, without wasteful overspray pattern deposits. One-pass formation of the deposited monolithic product was found to provide a better quality product, metallographically, than multi-pass deposition. For tests involving spray overlaps (i.e. 125 to 200 rpm of a rotating substrate), 6 to 8% porosity levels were observed throughout the thickness of the monolith. Exposing sections of sprayformed monoliths to hot isostatic pressing environments of 1100° C. at 207 MPa pressure for 2 to 3 hours showed very little effect on the porosity. Analysis of these observations produced a conclusion that the porosity is circumferentially interconnected. Hot rolling of the material resulted in weld-closure of the porosity. Single-pass deposition and a hotter substrate (above 600° C.) tend to reduce porosity.

Metallographic examination of the as-spray cast, hot rolled and hot isostatic pressed materials showed fine and relatively temperature-stable grains. The grain sizes of the spray cast material are comparable to those observed for rapidly solidified Type 316 stainless steel powders which were consolidated, after canning, by hot extrusion. Sprayforming, as described, avoids the trouble and expense of the cladding and decladding stages associated with powder consolidation.

What is claimed is:

1. A process for the production of an elongated monolithic metallic product having generally parallel sides, comprising, under an inert gas atmosphere:

melting a metal in a crucible having an opening in a bottom thereof;

passing molten metal through the bottom opening in the crucible and thereby forming a descending molten metal stream;

atomizing the molten metal stream with inert gas primary jets disposed about the metal stream to form a plume of molten metal droplets;

blowing onto at least a portion of a lower portion of the plume auxiliary jets of inert gas oriented generally parallel to the generally parallel sides of the elongated metallic product, thereby restricting the sides of the plume, without substantially affecting an inner portion thereof, to a deflected pattern of high metal droplet density so as to form the elongated monolithic product having generally parallel sides; and projecting the plume onto a generally linearly moving substrate to deposit metal forming the elongated monolithic product having generally parallel sides substantially without undesirable overspray at product edges deposited by the deflected plume pattern.

2. A process according to claim 1, wherein atomization of the molten metal stream is carried out at a location substantially where the molten metal stream exits the opening in the bottom of the crucible.

3. A process according to claim 2, further comprising heating the substrate to an extent to reduce the porosity of the deposited product.

4. A process according to claim 3 wherein the auxiliary inert gas is heated to an extent to reduce its cooling effect on the plume of metal droplets.

5. A process according to claim 4, wherein the substrate is heated to a temperature of at least about 600° C.

6. A process according to claim 4, wherein the product is deposited in a single pass of the substrate past the deflected plume of atomized metal droplets.

* * * * *